US006841038B2

(12) United States Patent
Horenziak et al.

(10) Patent No.: US 6,841,038 B2
(45) Date of Patent: Jan. 11, 2005

(54) SOFT ABSORBENT WEB MATERIAL

(75) Inventors: Steven Anthony Horenziak, Fairfield, OH (US); Ward William Ostendorf, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 207 days.

(21) Appl. No.: 10/252,329

(22) Filed: Sep. 23, 2002

(65) Prior Publication Data

US 2003/0056916 A1 Mar. 27, 2003

Related U.S. Application Data

(60) Provisional application No. 60/324,305, filed on Sep. 24, 2001.

(51) Int. Cl.[7] ..... D21H 27/38

(52) U.S. Cl. ..... 162/129; 162/130; 162/146; 162/157.6; 428/326; 428/536; 428/537.5

(58) Field of Search ..... 162/146, 157.6, 162/129, 130, 132, 135; 428/536, 326, 537.5

(56) References Cited

U.S. PATENT DOCUMENTS

| | | | |
|---|---|---|---|
| 4,166,001 | A | 8/1979 | Dunning et al. |
| 4,246,221 | A | 1/1981 | McCorsley, III |
| 5,164,045 | A | 11/1992 | Awofeso et al. |
| 5,437,908 | A | 8/1995 | Demura et al. |
| 5,538,595 | A | 7/1996 | Trokhan et al. |
| 5,620,565 | A | 4/1997 | Lazorisak et al. |
| H1672 | H | 8/1997 | Hermans et al. |
| 5,725,821 | A | 3/1998 | Gannon et al. |

(List continued on next page.)

FOREIGN PATENT DOCUMENTS

| | | |
|---|---|---|
| EP | 1 243 697 A | 9/2002 |
| GB | 2 325 248 A | 11/1998 |
| JP | 08 275287 | 10/1996 |
| JP | 08 275292 | 10/1996 |
| WO | WO 98/01620 | 1/1998 |
| WO | WO 01/88266 A1 | 11/2001 |

OTHER PUBLICATIONS

Johnson, P.A.; Courtaulds Fibres R&T, Courtaulds' Lyocell® Fiber for Papermaking Applications, 1997 Nonwovens Conference: Proceedings Memphis, TN, Abstract No. 12012.

Ball, R.C., Cavendish Laboratory, Mortimer, S.A., Universite Joseph Fourier, Peguy, A. A., Cellulose Chemistry and Technology 30, No. ¾: 251–266, Abstract No. 9943.

Hyun Suk Whang, Bhupender S. Gupta, Surface Wetting Characteristics of Cellulosic Fibers, Textile Res. J. 70(4), 351–358 (2000).

David W. Farrington, Jane Oldham, Tencel A100, JSDC, vol. 115, Mar. 1999, p. 83–85.

Prof. Dr. H. Struszcyk, Cellulose Fibers: State of the Art and Developmemt Forecast, Chemical Fibers International, vol. 46, 1996, p. 265–267.

(List continued on next page.)

*Primary Examiner*—Peter Chin
(74) *Attorney, Agent, or Firm*—David K. Mattheis; David M. Weirich; Ken K. Patel

(57) ABSTRACT

A web comprised of lyocell fibers. The web may be a homogeneous blend of fibers with lyocell fibers having a length of less than about 6 mm as a portion of the blend. The web may be a multi layered single ply with lyocell fibers in one or more layers. The web may be composed of multiple plies, with component plies composed of multiple layers. The length and proportion of the lyocell fibers in the respective layers of the component plies may vary intentionally from layer to layer.

12 Claims, 2 Drawing Sheets-

U.S. PATENT DOCUMENTS

| | | | | |
|---|---|---|---|---|
| 5,935,880 | A | | 8/1999 | Wang et al. |
| 6,042,769 | A | | 3/2000 | Gannon et al. |
| 6,093,355 | A | | 7/2000 | Newbury et al. |
| 6,653,406 | B1 | * | 11/2003 | Soerens et al. ..... 525/212 |

OTHER PUBLICATIONS

Tencel, Inc., Techniques for Fibrillating Tencel® Fiber for Papermaking, tencel cdrom\library\Technical\papers3\.

Jim Taylor, Andy Fairbrother, Tencel—it's more than just peachskin, JSDC, vol. 116, Dec. 2000, p. 381–384.

Dr. Jurgen Lenz, Dr. Josef Schurz, Dr. Dieter Eichinger, Properties and Structure of Lyocell and Viscose–Type Fibres In the Swollen State, Lenzinger Berichte, vol. 74, Sep. 1994, p. 19–25.

J. Crawshaw, R.E. Cameron, A Small Angle X–ray Scattering Study of Pore Structure in Tencel® Cellulose Fibres and the Effects of Physical Treatments, Elsevier Science Ltd., Polymer 41 (2000), 4691–4698.

J. Gacen, A. Naik, D. Cayuela, I. Gacen, Tensile Parameters of Cellulosic Chemical Fibres as a Function of the Degree of Polymerization, J. Text, Inst., 2000, vol. 91, Part 1, No. 1, p. 173–178.

Courtaulds Lyocell—New Developments, Chemical Fibers International, vol. 47, Issue 2, Apr. 1997, p. 127–129.

* cited by examiner

SOFT ABSORBENT WEB MATERIAL

CROSS REFERENCE TO RELATED APPLICATIONS

This application claims the benefit of U.S. Provisional Application No. 60/324,305, filed Sep. 24, 2001.

FIELD OF THE INVENTION

The present invention relates to absorbent, fibrous web materials. Specifically, the present invention relates to soft, absorbent, fibrous web materials comprised of lyocell fibers. The fibrous web materials may be used to produce soft, strong absorbent paper products.

BACKGROUND OF THE INVENTION

Paper webs or sheets, sometimes called tissue or paper tissue webs or sheets, find extensive use in modern society. Such items as paper towels, facial and toilet tissues are staple items of commerce. It has long been recognized that four important physical attributes of these products are their strength, their softness, their absorbency, including their absorbency for aqueous systems; and their lint resistance, including their lint resistance when wet. Research and development efforts have been directed to the improvement of each of these attributes without seriously affecting the others as well as to the improvement of two or three attributes simultaneously.

Strength is the ability of the product, and its constituent webs, to maintain physical integrity and to resist tearing, bursting, and shredding under use conditions, particularly when wet.

Softness is the tactile sensation perceived by the consumer as he/she holds a particular product, rubs it across his/her skin, or crumples it within his/her hand. This tactile sensation is provided by a combination of several physical properties. Important physical properties related to softness are generally considered by those skilled in the art to be the stiffness, the surface smoothness and lubricity of the paper web from which the product is made. Stiffness, in turn, is usually considered to be directly dependent on the dry tensile strength of the web and the stiffness of the fibers which make up the web.

Absorbency is the measure of the ability of a product, and its constituent webs, to absorb quantities of liquid, particularly aqueous solutions or dispersions. Overall absorbency as perceived by the consumer is generally considered to be a combination of the total quantity of liquid a given mass of tissue paper will absorb at saturation as well as the rate at which the mass absorbs the liquid.

Lint resistance is the ability of the fibrous product, and its constituent webs, to bind together under use conditions, including when wet. In other words, the higher the lint resistance is, the lower the propensity of the web to lint will be.

It is an objective of this invention to provide a soft, absorbent web material that is also strong both when wet and dry, and that has good lint resistance.

SUMMARY OF THE INVENTION

A soft, absorbent, strong web material comprised of lyocell fibers. The web may be a homogeneous blend of lyocell and other types of fibers, wherein no more than 60% by weight of the lyocell fibers of the blend have a length greater than, or equal to, 6 mm. The web may be a layered, single ply web wherein one or more layers of the ply are comprised of lyocell fibers. Such a layered web may have lyocell fibers of different lengths and varying amounts in different layers. Optionally, the web may be a multi ply web of multi layered plies, wherein one or more of the layers of such are comprised of lyocell fibers. Such multiple plies may be laminated together with layers comprised of lyocell fibers on the outer surfaces of the web. Alternatively, such a web may have layers comprised of lyocell disposed in the interior of the web. It is further possible that all the layers of such a multi ply, multi layer web be comprised of lyocell fibers such that different lengths of lyocell fibers in varying quantities are present in the outer layers of the multi ply web, and the interior of the multi ply web.

All percentages, ratios and proportions herein are by weight unless otherwise specified.

DETAILED DESCRIPTION OF THE INVENTION

Figure 1:
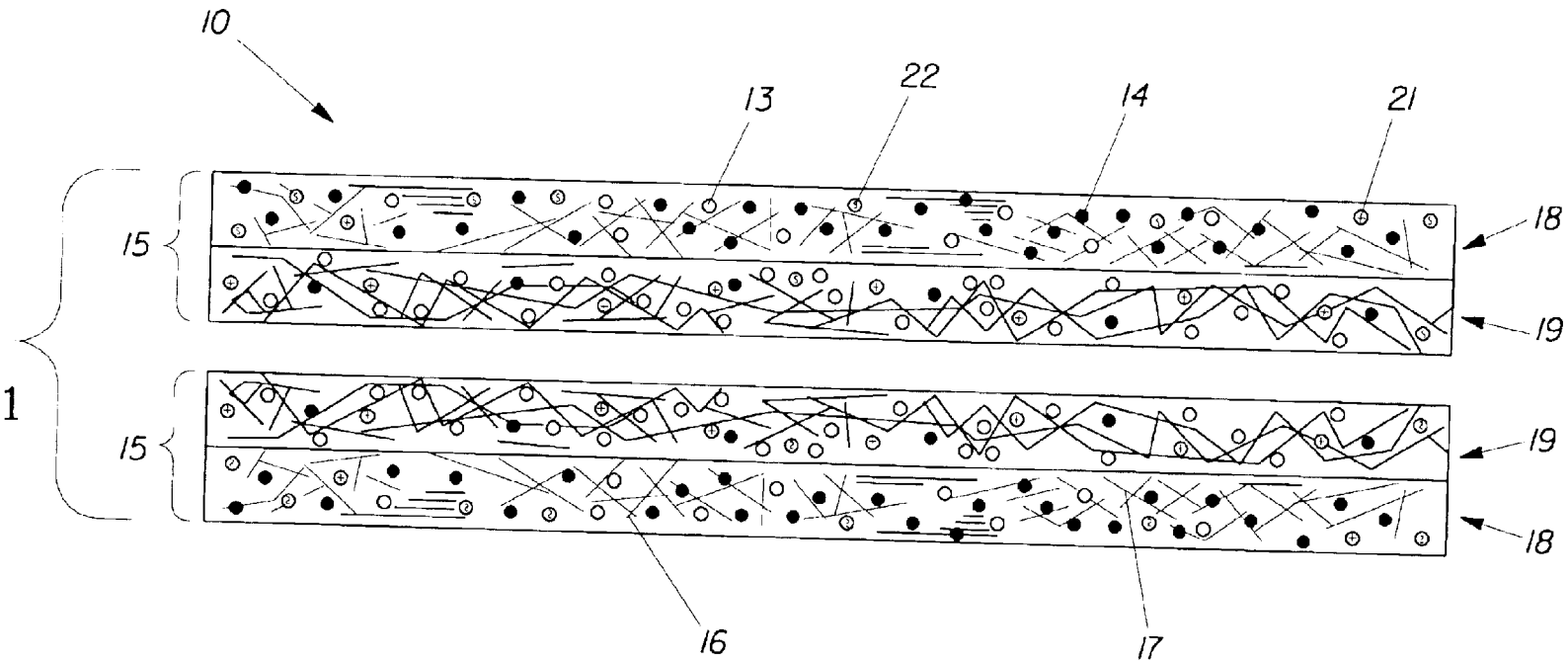
FIG. 1 is a schematic cross-sectional view of a two-ply, two-layer tissue paper in accordance with the present invention.

The physical characteristics of a paper web are influenced by many factors. These factors include, but are not limited to, the length, denier, and type of fibers present in the web, the proportions of the respective fiber types, chemical additives, and the method of making the paper. Applicants have surprisingly found that a soft, absorbent, strong paper web can be produced, using conventional and through air drying paper machines, through the addition of particular proportions of lyocell fibers having particular lengths. Embodiments of the invention have improved softness with absorbency at least equivalent to a typical paper web. The webs of the invention may also have an improved ratio of wet burst strength to total tensile strength when compared to a paper web without lyocell fibers. The webs may also have improved softness with high lint resistance.

Lyocell fibers are solvent spun cellulose fibers produced by extruding a solution of cellulose into a coagulating bath. Lyocell fiber is to be distinguished from cellulose fiber made by other known processes, which rely on the formation of a soluble chemical derivative of cellulose and its subsequent decomposition to regenerate the cellulose, for example the viscose process. Lyocell is a generic term for fibers spun directly from a solution of cellulose in an amine oxide. The production of lyocell fibers is the subject matter of many patents. Examples of solvent-spinning processes for the production of lyocell fibers are described in: U.S. Pat. No. 4,246,221: U.S. Pat. No. 5,725,821: U.S. Pat. No. 6,042,769; U.S. Pat. No. 6,258,304; U.S. Pat. No. 6,241,927; U.S. Pat. No. 6,235,392; U.S. Pat. No. 6,210,801; U.S. Pat. No. 6,153,136; U.S. Pat. No. 6,103,162; U.S. Pat. No. 5,939,000; U.S. Pat. No. 5,919,412; U.S. Pat. No. 5,766,530 the disclosures of which patents are incorporated herein by reference. The practice of the present invention is not limited to the use of lyocell fibers produced according to the patents of the preceding list. The non-exhaustive list is intended to provide examples of processes for the manufacture of lyocell fibers. Lyocell fibers are available in a broad range of fiber lengths and diameters. The fibers used in the embodiments of the present invention range from 0.5 mm to 8 mm and from 0.8 to 5.0 denier, optionally 1 to 4 denier, and alternatively 1.5 to 3 denier.

As used herein, the terms "tissue paper web, paper web, web, paper sheet and paper product" all refer to sheets of paper, or sheet-like materials, made by a process comprising the steps of forming an aqueous paper making furnish, depositing this furnish on a foraminous surface, such as a Fourdrinier wire, and removing the water from the furnish as by gravity or vacuum-assisted drainage, with or without pressing, and by evaporation.

As used herein, an "aqueous paper making furnish" is an aqueous slurry of paper making fibers and the chemicals described hereinafter.

As used herein, the term "multi-layered tissue paper web, multi-layered paper web, multi-layered web, multi-layered paper sheet and multi-layered paper product" all refer to sheets of paper prepared from two layers of aqueous paper making furnish which are preferably comprised of different fiber types. The layers may be formed from the deposition of separate streams of dilute fiber slurries, upon one or more endless foraminous screens. If the individual layers are initially formed on separate wires, the layers are subsequently combined (while wet) to form a layered composite web.

As used herein the terms "multi-ply tissue paper product, and multi-ply web" refers to a paper consisting of at least two plies. Each individual ply in turn can consist of single-layered or multi-layered tissue paper webs. The multi-ply structures are formed by bonding together two or more tissue webs such as by gluing or embossing.

The paper web may be blended. By blended it is meant that the paper web comprises a homogeneous mixture of fibers. The lyocell fibers can comprise from about 3% to about 70% by weight of the fiber mixture. Optionally, the lyocell fibers may comprise from about 7% to about 60% of the fiber mixture. Alternatively, the lyocell fibers may comprise from about 10% to about 50% of the fiber mixture. In another alternative, the lyocell fibers may comprise from about 12% to about 40% of the total fiber mixture. In still another alternative, the lyocell fibers may comprise from about 15% to about 35% of the fiber mixture. In yet another alternative, the lyocell fibers may comprise from about 17% to about 30% of the total fiber mixture. In yet one more alternative, the lyocell fibers may comprise from about 20% to about 25% of the total fiber mixture.

The lyocell fibers of the present invention may have a lower fiber length limit of about 0.5 mm. The lower fiber length limit is the fiber length corresponding to the shortest fibers intentionally present in the web of the invention. Those skilled in the art will recognize that "fines", fibers of short fiber length, will be unintentionally present in the web. Optionally, the lower fiber length limit may be about 1 mm. Alternatively, the lower limit may be about 1.5 mm. In another alternative, the lower limit may be about 2 mm. In still another alternative, the lower limit may be about 2.5 mm. Similarly; the lyocell fibers have an upper fiber length limit corresponding to the longest fiber length intentionally present in the webs of the present invention. The upper fiber length limit may be about 8 mm. The upper fiber length limit may alternatively be about 6 mm. Optionally; the upper limit may be about 5.5 mm. Alternatively, the upper limit may be about 5 mm. In another alternative, the upper limit may be about 4.5 mm. In yet another alternative, the upper limit may be about 4 mm. In still another alternative, the upper limit may be about 3.5 mm. In still yet another alternative, the upper limit may be about 3 mm.

Up to about 60% by weight of the lyocell fibers in a homogeneously blended web may have a length of about 6 mm or greater, the remaining lyocell fibers having lengths less than about 6 mm. Optionally, up to about 50% by weight of the lyocell fibers may have a length of about 6 mm or greater. Alternatively, up to about 40% by weight of the lyocell fibers may have a length of about 6 mm or greater. In another alternative, up to about 30% by weight of the lyocell fibers may have a length of about 6 mm or greater. In still another alternative, up to about 20% by weight of the lyocell fibers may have a length of about 6 mm or greater. In still yet another alternative, up to about 10% by weight of the lyocell fibers may have a length of about 6 mm or greater. In another alternative embodiment, up to about 5% by weight of the lyocell fibers may have a length of about 6 mm or greater.

The paper web according to the present invention may be multi layered. In multi layered embodiments, the length and proportions of lyocell fibers in each layer may be varied. It is possible to make a two-layered web with lyocell fibers in only one of the two layers, or with lyocell fibers present in each layer. The length and relative proportion of lyocell fibers in such layers may be varied in the same manner as set forth above for a homogeneously blended web. In a particular layered web, the proportion of lyocell fibers in one layer is from about 35% to about 45% of the weight of the fibers in that layer. The remainder of the fiber weight of each layer is comprised of non-lyocell papermaking fibers.

It is anticipated that wood pulp in all its varieties will normally comprise the balance of the paper making fibers used in this invention. However, other cellulose fibrous pulps, such as cotton linters, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Synthetic fibers such as rayon, polyethylene and polypropylene fibers, may also be utilized in combination with the above-identified natural cellulose fibers, and the lyocell fibers. One exemplary polyethylene fiber which may be utilized is PULPEX®, available from Hercules, Inc. (Wilmington, Del.).

Both hardwood pulps and softwood pulps may be employed. The terms hardwood pulps as used herein refers to fibrous pulp derived from the woody substance of deciduous trees (angiosperms): wherein softwood pulps are fibrous pulps derived from the woody substance of coniferous trees (gymnosperms). Also applicable to the present invention are low cost fibers derived from recycled paper, which may contain any or all of the above categories as well as other non-fibrous materials such as fillers and adhesives used to facilitate the original paper making.

The present invention is applicable to tissue paper in general, including but not limited to conventionally felt-pressed tissue paper; high bulk pattern densified tissue paper; and high bulk, uncompacted tissue paper. The tissue paper products made therefrom may be of a single-layered or multi-layered construction. Tissue structures formed from layered paper webs are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987, U.S. Pat. No. 4,942,077 issued to Wendt et al. on Jul. 17, 1990, European Patent Publication No. 0 617 164 A1, Hyland et al., published Sep. 28, 1994, European Patent Publication No. 0 616074 A1, Hermans et al., published Sep. 21, 1994; all of which are incorporated herein by reference.

In general, pattern densified webs are preferably prepared by depositing a paper making furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the multi-layered tissue paper surface comprises densified knuckles having a relative density of at least 125% of the density of the high bulk field. The optional predrying may be accomplished using through air drying as is known in the art. The operating temperature utilized in the through air drying may be in the range from about 225 degrees Fahrenheit to about 525 degrees Fahrenheit. Applicants have surprisingly found that the web comprised of lyocell fibers may be predried to an equivalent consistency as a non-lyocell containing web of similar basis weight, utilizing a lower predrying temperature.

The array of supports is preferably an imprinting carrier fabric having a patterned displacement of knuckles, which operate as the array of supports, which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Uncompacted, nonpattern-densified multi-layered tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified multi-layered tissue paper structures are prepared by depositing a paper making furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The webs of the invention may be made without the use of a Yankee drier, in accordance with U.S. Pat. No. 5,772,845, issued Jun. 30, 1998 to Farrington, et al., which patent is incorporated herein by reference. The webs may be foreshortened by creping, or by other means such as wet micro contraction as is known in the art.

The webs of the present invention may be used in any application where soft and/or absorbent products are required. Particularly advantageous, though non-limiting uses of the invention are in paper towels, facial and bath tissues. The webs may also be used in absorbent articles, for example, diapers, and feminine hygiene products, as well as in wipes type products such as pre-moistened baby wipes and analogous products.

A web produced in a papermaking machine has two distinct surfaces, a wire contacting surface, or wire contacting side, and a fabric contacting surface, or fabric contacting side. The wire contacting side is the surface of the web in contact with the forming wire of the machine. The fabric contacting side is that surface in contact with the drying fabric of the paper machine. Embodiments of the present invention may be produced with lyocell fibers in the wire contacting layer, the fabric contacting layer or both.

It is possible to join multiple plies of such a layered paper web to each other forming a laminated web. The plies may be joined such that layers with short lyocell fibers are oriented inward toward each other in the interior of the laminated web and layers comprised of long lyocell fibers oriented outward. Alternatively, the layers comprised of long fibers may be oriented inward and the layers comprised of short fibers oriented outward.

FIG. 1 is a schematic cross-sectional view of a two-layered, two-ply web in accordance with the present invention. Referring to FIG. 1, the two-layered, two-ply web 10, is comprised of two plies 15 in juxtaposed relation. Each ply 15 is comprised of inner layer 19, and outer layer 18. A multi ply paper may be produced from individual multi layer plies having lyocell fibers in only one layer of each ply. A multi ply paper with lyocell in the outer layers 18, benefits from the softness of lyocell fibers and can have a better hand feel than a paper having no lyocell in the outer layers 18. A paper with a high percentage of lyocell fibers in the interior layers 17, benefits from the absorbency of lyocell fibers and can have a high absorbent capacity.

Such a multi ply web comprised of multi layer plies may be produced with lyocell fibers in all layers, alternatively with lyocell fibers exclusively in the outer layers and, in another alternative, with lyocell fibers exclusively in the interior facing layers.

Chemical Additives:

The attributes of the paper webs of the present invention may be further impacted by the use of chemical additives. The process for manufacturing the webs may also be made more reliable through the addition of selected chemical additives. Additives for enhancing absorbency, dry strength, softness, and lint resistance may be incorporated into the webs of the present invention. Temporary and permanent wet strength enhancing additives and wetting agents may also be incorporated into the webs. The use of such chemicals is well known in the art. Examples relating the use of such additives may be found in U.S. Pat. No. 5,538,595, issued Jul. 23, 1996 to Trohkan, et al. and U.S. Pat. No. 5,573,637, issued Nov. 12, 1996 to Ampulski et al. the disclosures of which patents are incorporated herein by reference. Wetting agents to improve the reliability of the manufacturing process may also be added.

Two Component Chemical Softener Compositions

The present invention may contain a chemical softening composition. Such a softening composition may comprise an ester-functional quaternary ammonium compound, or a quaternary ammonium compound. Alternatively, such a softening compound may comprise an ester-functional quaternary ammonium compound and a polysiloxane compound, or a quaternary ammonium compound and a polysiloxane compound.

A. Ester-functional Quaternary Ammonium Compounds:

Specific non-limiting examples of ester-functional quaternary ammonium compounds suitable for use in the present invention include the well-known di-ester di(alkyl) dimethyl ammonium salts such as di-ester ditallow dimethyl ammonium chloride, mono-ester ditallow dimethyl ammonium chloride, di-ester ditallow dimethyl ammonium methyl sulfate, di-ester di(hydrogenated)tallow dimethyl ammonium methyl sulfate, di-ester di(hydrogenated)tallow dimethyl ammonium chloride, and mixtures thereof.

B. Quaternary Ammonium Compounds:

Examples of quaternary ammonium compounds suitable for use in the present invention include the well-known dialkyldimethylammonium salts such as ditallow dimethyl ammonium chloride, ditallow dimethylammonium methyl sulfate, and di(hydrogenated)tallow dimethyl ammonium chloride.

C. Polysiloxane Compounds:

In general, suitable polysiloxane materials for use in the present invention include those having monomeric siloxane units of the following structure:

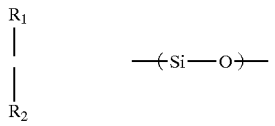

wherein, $R_1$ and $R_2$, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the polysiloxane can be either a straight chain, a branched chain or have a cyclic structure. The radicals $R_1$ and $R_2$ can additionally independently be other silaceous functionalities such as, but not limited to siloxanes, polysiloxanes, silanes, and polysilanes. The radicals $R_1$ and $R_2$ may contain any of a variety of organic functionalities including, for example, alcohol, carboxylic acid, aldehyde, ketone and amine, amide functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary arakyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotoyl, hexafluoroxylyl, and the like.

Viscosity of polysiloxanes useful may vary as widely as the viscosity of polysiloxanes in general vary, so long as the polysiloxane is flowable or can be made to be flowable for application to the tissue paper. The polysiloxane may have an intrinsic viscosity ranging from about 100 to about 1000 centipoises. References disclosing polysiloxanes include U.S. Pat. No. 2,826,551, issued Mar. 11, 1958 to Geen; U.S. Pat. No. 3,964,500, issued Jun. 22, 1976 to Drakoff; U.S. Pat. No. 4,364,837, issued Dec. 21, 1982, Pader, U.S. Pat. No. 5,059,282, issued Oct. 22, 1991 to Ampulski et al.; and British Patent No. 849,433, published Sep. 28, 1960 to Woolston. All of these patents are incorporated herein by reference. Also, incorporated herein by reference is Silicon Compounds, pp 181–217, distributed by Petrarch Systems, Inc., 1984, which contains an extensive listing and description of polysiloxanes in general.

Wet Strength Binder Materials:

A. Permanent Wet Strength Binder Materials

The permanent wet strength binder materials are chosen from the following group of chemicals: polyamide-epichlorohydrin, polyacrylamides, styrenebutadiene latexes; insolubilized polyvinyl alcohol; urea-formaldehyde; polyethyleneimine; chitosan polymers and mixtures thereof. The permanent wet strength binder materials may be selected from the group consisting of polyamide-epichlorohydrin resins, polyacrylamide resins, and mixtures thereof. The permanent wet strength binder materials act to control linting and also to offset the loss in tensile strength, if any, resulting from the chemical softener compositions.

Polyamide-epichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the trade-mark KYMENE® 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the trade-mark PAREZ® 631 NC. Still other water-soluble cationic resins finding utility in this invention are urea formaldehyde and melamine formaldehyde resins.

B. Temporary Wet Strength Binder Materials

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties. More recently, manufacturers have added temporary wet strength additives to paper products for which wet strength is sufficient for the intended use, but which then decays upon soaking in water. Decay of the wet strength facilitates flow of the paper product through septic systems.

Examples of suitable temporary wet strength resins include modified starch temporary wet strength agents, such as National Starch 78-0080, marketed by the National Starch and Chemical Corporation (New York, N.Y.). This type of wet strength agent can be made by reacting dimethoxyethyl-N-methyl-chloroacetamide with cationic starch polymers. Modified starch temporary wet strength agents are also described in U.S. Pat. No. 4,675,394, Solarek, et al., issued Jun. 23, 1987, and incorporated herein by reference. Temporary wet strength resins include those described in U.S. Pat. No. 4,981,557, Bjorkquist, issued Jan. 1, 1991, and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

Dry Strength Binder Materials

The present invention contains as an optional component from about 0.01% to about 3.0%, and alternatively from about 0.01% to about 1.0% by weight of a dry strength binder material chosen from the following group of materials: polyacrylamide (such as combinations of CYPRO® 514 and ACCOSTRENGTH® 711 produced by American Cyanamid of Wayne, N.J.); starch (such as REDIBOND® 5320 and 2005) available from National Starch and Chemical Company, Bridgewater, N.J.; polyvinyl alcohol (such as AIRVOL® 540 produced by Air Products Inc of Allentown, Pa.); guar or locust bean gums; and/or carboxymethyl cellulose (such as CMC from Hercules, Inc. of Wilmington, Del.). The dry strength binder materials may be selected from the group consisting of carboxymethyl cellulose resins, and unmodified starch based resins and mixtures thereof. The dry strength binder materials act to control linting and also to offset the loss in tensile strength, if any, resulting from the chemical softener compositions.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is also usable. Amioca starch differs from common corn starch in that it is entirely amylopectin, whereas common corn starch contains both amplopectin and amylose. Various unique characteristics of amioca starch are further described in "Amioca—The Starch from Waxy Corn", H. H. Schopmeyer, Food Industries, December 1945, pp. 106–108 (Vol. pp. 1476–1478). The starch can be in granular or dispersed form. The starch may be sufficiently cooked to induce swelling of the granules. Alternatively, the starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4.times. consistency of starch granules at about 190.degree. F. (about 88.degree. C.) for between about 30 and about 40 minutes.

Wetting Agents:

The present invention may contain as an optional ingredient from about 0.1% to about 3.0%, alternatively, from about 0.03% to about 1.0% by weight, on a dry fiber basis of a wetting agent. Wetting agents may be used to improve the performance of low grade fiber sources, as well as to improve the reliability of the manufacturing process used to make the webs of the invention.

Polyhydroxy Compound

The chemical softening composition contains as an optional component from about 0.01% to about 3.00% by weight, preferably from about 0.01% to about 1.00% by weight of a water soluble polyhydroxy compound.

Examples of polyhydroxy compounds useful in the present invention include glycerol, polyglycerols having a weight average molecular weight of from about 150 to about 800 and polyoxyethylene glycols and polyoxypropylene glycols having a weight average molecular weight of from about 200 to about 4000, preferably from about 200 to about 1000, most preferably from about 200 to about 600. Polyoxyethylene glycols having an weight average molecular weight of from about 200 to about 600 are especially preferred. Mixtures of the above-described polyhydroxy compounds may also be used. For example, mixtures of glycerol and polyoxyethylene glycols having a weight average molecular weight from about 20 to 1000, more preferably from about 200 to 600 are useful in the present invention. The weight ratio of glycerol to polyoxyethylene glycol may range from about 10:1 to 1:10.

Nonionic Surfactant (Alkoxylated Materials)

Suitable nonionic surfactants that can be used as wetting agents in the present invention include addition products of ethylene oxide and, optionally, propylene oxide, with fatty alcohols, fatty acids, fatty amines, etc.

Any of the alkoxylated materials of the particular type described hereinafter can be used as the nonionic surfactant. Suitable compounds are substantially water-soluble surfactants of the general formula:

$$R_2—Y—(C_2H_4O)_2—C_2H_4OH$$

wherein $R_{.2}$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. Alternatively the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R_2$, and R, when present, have the meanings given herein before, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophiliclipophilic balance) of from about 7 to about 20, preferably from about 8 to about 15. Of course, by defining $R_{.2}$ and the number of ethoxylate groups, the HLB of the surfactant is, in general, determined. However, it is to be noted that the nonionic ethoxylated surfactants useful herein, for concentrated liquid compositions, contain relatively long chain $R_{.2}$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

Linear Alkoxylated Alcohols

A. Linear, Primary Alcohol Alkoxylates

The deca-, undeca-, dodeca-, tetradeca-, and pentadeca-ethoxylates of n-hexadecanol, and n-octadecanol having an HLB within the range recited herein are useful wetting agents in the context of this invention. Exemplary ethoxylated primary alcohols useful herein as the viscosity/dispersibility modifiers of the compositions are n-$C_{18}$ EO(10); and n-$C_{10}$ EO(11). The ethoxylates of mixed natural or synthetic alcohols in the "oleyl" chain length range are also useful herein. Specific examples of such materials include oleylalcohol-EO(11), oleylalcohol-EO(18), and oleylalcohol-EO(25).

B. Linear, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein can be used as wetting agents in the present invention. Exemplary ethoxylated secondary alcohols can be used as wetting agents in the present invention are: 2-$C_{16}$ EO(11); 2-$C_{20}$ EO(11); and 2-$C_{16}$ EO(14).

Linear Alkyl Phenoxylated Alcohols

As in the case of the alcohol alkoxylates, the hexa- through octadecaethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the wetting agents of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately herein above can be ethoxylated to an HLB within the range recited herein can be used as wetting agents in the present invention.

Branched Chain Alkoxylates

Branched chain primary and secondary alcohols which are available from the well-known "OXO" process can be ethoxylated and can be used as wetting agents in the present invention.

The above ethoxylated nonionic surfactants are useful in the present invention alone or in combination, and the term "nonionic surfactant" encompasses mixed nonionic surface active agents.

The level of surfactant, if used, may be from about 0.01% to about 3.0% by weight, based on the dry fiber weight of the tissue paper. The surfactants may have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as CRODESTA® SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as PEGOSPERSE® ML available from Glyco Chemicals, Inc. (Greenwich, Conn.). IGEPAL® RC-520, available from Rhone Poulenc Corporation (Cranbury, N.J.) is a preferred surfactant.

The above listings of optional chemical additives is intended to be merely exemplary in nature, and are not meant to limit the scope of the invention.

Figure 2:
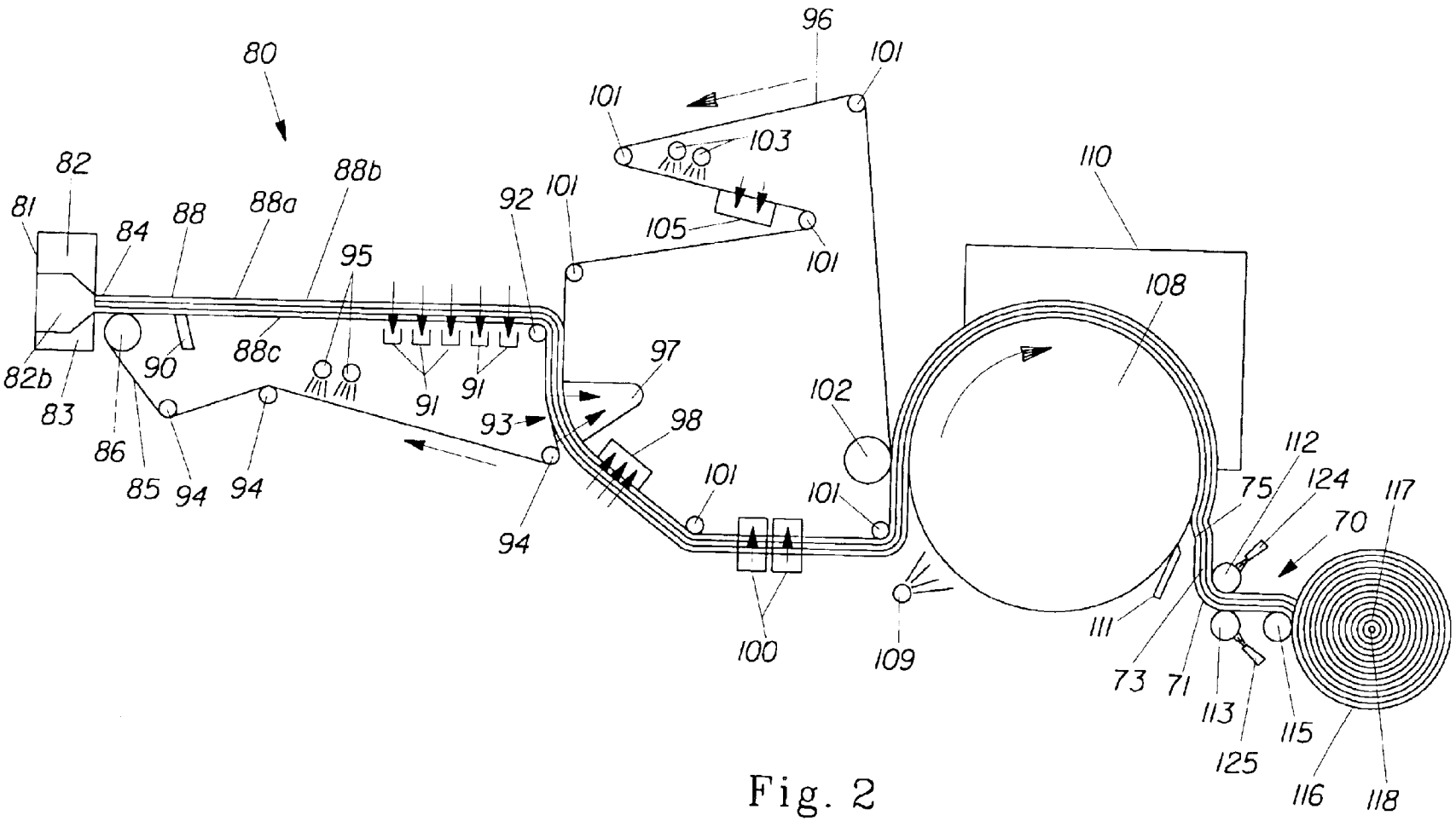
FIG. 2 is a schematic representation of a papermaking machine useful for producing a soft tissue paper in accordance with the present invention.

Paper Making Process:

FIG. 2 is a schematic representation illustrating a papermaking process for producing a soft absorbent web. This process is described in the following discussion, wherein reference is made to FIG. 2.

FIG. 2 is a side elevational view of an example of a papermaking machine 80 for manufacturing paper according to the present invention. Referring to FIG. 2, papermaking machine 80 comprises a layered headbox 81 having a top chamber 82 a center chamber 82*b*, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82*b*, while a third furnish is pumped through bottom chamber 83 and thence out of the slice roof 84 in over and under relation onto Fourdrinier wire 85 to form thereon an embryonic web 88 comprising layers 88*a*, and 88*b*, and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 aided by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118.

Still referring to FIG. 2, the genesis of Yankee-side layer 71 of paper sheet 70 is the furnish pumped through bottom chamber 83 of headbox 81, and which furnish is applied directly to the Fourdrinier wire 85 whereupon it becomes layer 88*c* of embryonic web 88. The genesis of the center layer 73 of paper sheet 70 is the furnish delivered through chamber 82*b* of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 2 shows papermachine 80 having headbox 81 adapted to make a three-layer web, headbox 81 may alternatively be adapted to make unlayered, two layer or other multi-layered webs.

Further, with respect to making paper sheet 70 embodying the present invention on papermaking machine 80, FIG. 2, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the inter-filamentary spaces of the fabric 96. Also, with respect to the process conditions for making exemplary paper sheet 70, the paper web is preferably dried to about 80% fiber consistency, and more preferably to about 95% fiber consistency prior to creping.

EXAMPLE

The following non-limiting example illustrates a paper web of the present invention.

Example 1

Stock chest A contains unrefined NSK at about 3% solids. Stock tank B contains a mixture of 40% by mass of unrefined, 4 mm, 1.5 denier lyocell, and 60% unrefined NSK. This mixture is present in the stock tank at about 1.75% solids. Stock chest C contains CTMP at about 2.0% solids. The NSK in stock chest A is pumped out at 11.5 gallons per minute (gpm), and passed through a refining step. A wet strength resin such as KYMENE® and/or carboxymethyl cellulose is then added to refined NSK. CTMP is pumped out of stock chest C at about 5.5 gpm. The NSK and CTMP are combined in fan pump #1 which also draws water from the wire pit so that the total flow from this pump is about 320 gpm. This mixture is then sent to the fabric side layer of a multi-layer headbox.

The lyocell/NSK mixture is pumped from stock tank B at a rate of about 9 gpm. Optionally, a strength resin such as KYMENE® and/or CMC is added for lint control. This mixture is pumped into fan pump #2 where it is combined with water from the wire pit so that the total flow from this pump is about 165 gpm. This mixture is then piped to the wire-side layer of a multi-layer headbox.

The sheet is then formed according to the usual papermaking process.

The resulting sheet has a basis weight of about 13.7 lb/3000 ft^2. The wire-side layer, consisting of a 40:60 lyocell:NSK mixture, represents about 30% of the total sheet weight, or about 4 lb/3000 ft^2.

Optionally, the NSK and lyocell in the fabric layer may be drawn from separate stock chests rather than being premixed into a single stock chest. In this case the lyocell is present in the stock tank at about 1.0% solids, the NSK at about 3.0% solids. Optionally strength chemicals may be added to the lyocell, NSK, or both for lint control.

What is claimed is:

1. A multi layer, single ply web comprising a first layer further comprising lyocell fibers, and a second layer substantially devoid of lyocell fibers.

2. A web according to claim 1, wherein the lyocell fibers comprise from about 3% to about 70 % by weight of the first layer.

3. A web according to claim 1, further comprising a wetting agent.

4. A web according to claim 3, wherein the wetting agent is selected from the group consisting of polyhydroxy compounds, linear alkoxylated alcohols, linear phenoxylated alcohols, olefinic alkoxylates, branched chain alkoxylates, and mixtures thereof.

5. A multi layer, single ply web according to claim 1, wherein the lyocell fibers have a length from about 0.5 mm to about 3.5 mm.

6. A multi layer, single ply web, comprising a first layer and a second layer, wherein the first layer further comprises lyocell fibers having a length from about 0.5 mm to about 3.5 mm, and wherein the second layer further comprises lyocell fibers, wherein the lyocell fibers of the second layer have a length from about 4 mm to about 6 mm.

7. A multi layer, single ply web according to claim 6, wherein the lyocell fibers of the first layer comprise from about 3% to about 70% by weight of the first layer, and the lyocell fibers of the second layer comprise from about 3% and about 70% by weight of the second layer.

8. A multi layer, multi ply web comprising:

a multi layer first ply further comprising:

a first layer further, and a second layer:

a multi layer second ply further comprising:

a first layer further, and a second layer and wherein:

the first layer of the first ply further comprises from about 15% to about 25% by weight lyocell fibers having a length from about 1.5 mm to about 3 mm;

the first layer of the second ply further comprises from about 15% to about 25% by weight lyocell fibers having a length from about 1.5 mm to about 3 mm;

the second layer of the first ply further comprises from about 35% to about 45% by weight lyocell fibers having a length from about 3.5 mm to about 5 mm;

the second layer of the second ply further comprises from about 35% to about 45% by weight lyocell fibers having a length from about 3.5 mm to about 5 mm;

the first layer of the first ply and the first layer of the second ply are disposed in a face-to-face relationship to each other.

9. A multi layer, multi ply web according to claim 8, wherein the first layer of the first ply, and the first layer of the second ply are disposed in a face-to-face relationship with each other.

10. A multi layer, multi ply web according to claim 8, wherein the second layer of the first ply, and the second layer of the second ply are disposed in a face-to-face relationship with each other.

11. A multi layer, multi ply web according to claim 8, wherein the plies of the paper are embossed.

12. A multi layer, multi ply web according to claim 11 wherein the embossed plies are adhesively bonded to each other at least some of the embossments.

* * * * *